United States Patent [19]

Erickson

[11] Patent Number: 4,769,055

[45] Date of Patent: Sep. 6, 1988

[54] COMPANDED TOTAL CONDENSATION REBOIL CRYOGENIC AIR SEPARATION

[76] Inventor: Donald C. Erickson, Energy Concepts Co., 627 Ridgely Avenue, Annapolis, Md. 21401

[21] Appl. No.: 10,332

[22] Filed: Feb. 3, 1987

[51] Int. Cl.[4] ..... F25J 3/04

[52] U.S. Cl. ..... 62/22; 62/25; 62/34; 62/39

[58] Field of Search ..... 62/9, 11, 22–28, 62/31, 32, 34, 36, 38, 39, 41, 42

[56] References Cited

U.S. PATENT DOCUMENTS

| | | | |
|---|---|---|---|
| 3,905,201 | 9/1975 | Coveney et al. | 62/38 X |
| 4,224,045 | 9/1980 | Olszewski et al. | 62/38 X |
| 4,357,153 | 11/1982 | Erickson | 62/34 |
| 4,533,375 | 8/1985 | Erickson | 62/31 X |
| 4,543,115 | 9/1985 | Agrawal et al. | 62/25 |

FOREIGN PATENT DOCUMENTS

| | | |
|---|---|---|
| 2854508 | 6/1980 | Fed. Rep. of Germany . |
| 845542 | 7/1984 | South Africa . |
| 1271419 | 4/1972 | United Kingdom . |
| 756150 | 8/1980 | U.S.S.R. . |

OTHER PUBLICATIONS

Streich, et al., "Production of Large Quantities of Oxygen by an Improved Two-Column Process," XIV Internatinal Congress of Refrigeration, pp. 513–519.

*Primary Examiner*—Steven E. Warner

[57] ABSTRACT

In a cryogenic air distillation process for producing medium-to-high purity oxygen plus optional coproduct argon, a new process sequence results in more efficient distillations at reduced supply pressure and full $O_2$ recovery. Reforming to FIG. 2, a minor stream of supply air is additionally compressed by compander 204, cooled, and then reboils column 201 by total condensation in reboiler 205. The liquid air is split into two intermediate reflux streams, one for each column 201 and 202, valves 206 and 207, thereby improving the efficiency of both columns. The air condensing in 205 is somewhat hotter than that supplied to 202, due to its higher pressure, which permits a reduction in the main supply pressure.

26 Claims, 5 Drawing Sheets

COMPANDED TOTAL CONDENSATION REBOIL CRYOGENIC AIR SEPARATION

DESCRIPTION

1. Technical Field

This invention relates to processes and apparatus for separating air into oxygen of any purity plus optional coproduct argon via cryogenic fractional distillation. The invention makes possible a substantial reduction in the energy hitherto required for these products, by incorporating a novel method of reboiling the nitrogen rejection column which increases the efficiency of the fractional distillations and lowers the required air supply pressure.

2. Background Art

Conventional cryogenic air separation processes normally involve at least two fractional distillation columns: a low pressure (LP) column, also termed a nitrogen rejection column, from which is withdrawn fluid oxygen bottom product of specified purity plus gaseous nitrogen overhead product, to be rejected back to the atmosphere, plus a high pressure (HP) rectifier which receives the feed air, provides reboil to the LP column and liquid $N_2$ ($LN_2$) reflux for both columns by indirect exchange of latent heat between the two columns, and provides oxygen enriched liquid air bottom product (kettle liquid) which is subsequently fed to the LP column.

It is known to reboil the bottom of the LP column by latent heat exchange with any of three gases: HP rectifier overhead $N_2$; partially condensing feed air (U.S. Pat. Nos. 3,113,854, 3,711,496, 3,327,489, 3,688,513, and 4,578,095); or totally condensing feed air (U.S. Pat. Nos. 3,210,951, 4,208,199, 4,410,343 and 4,448,595). Similarly it is known to evaporate the liquid oxygen bottom product of the LP column to gaseous oxygen product by latent heat exchange with any of the same three gases. U.S. Pat. Nos. 3,113,854, 3,371,496, 3,327,489, and 4,560,398 disclose partial condensation LOXBOIL, while U.S. Pat. Nos. 3,210,951, 4,133,662, 4,208,199, 4,410,343, and 4,507,134 disclose total condensation LOXBOIL.

U.S. Pat. Nos. 3,210,951 and 4,410,343 both show a single heat exchanger in which about 40 to 56% of the feed air is totally condensed to provide both LOXBOIL and LP column reboil, and then the liquid air is divided and fed to both columns. U.S. Pat. No. 3,798,917 discloses evaporating part of a supply of very low purity (70%) liquid oxygen via latent heat exchange with a minor fraction of the supply air, which is totally condensed thereby, and then the liquid air is divided into three fractions: one for indirect refluxing of the HP rectifier overhead, and the other two for direct injection intermediate height refluxing of both the HP rectifier and LP column. U.S. Pat. No. 4,448,595 discloses a nitrogen production process wherein the lower pressure column is reboiled by total condensation of a fraction of the supply air which is at an elevated pressure, and then the liquid air is divided between both columns.

In many flowsheets, for example, when the LP column is reboiled by HP rectifier $N_2$, and LOXBOIL is via air condensation, the LOXBOIL pressure is somewhat higher than the LP column bottom pressure. Although that pressure increase could be accomplished by a liquid oxygen pump, a preferred method is to use the barometric or hydrostatic head of a column of liquid oxygen, i.e., boil the LOX at a suitably lower elevation than the LP column bottoms reboiler. This is disclosed in U.S. Pat. Nos. 4,133,662, 4,507,134, 4,560,398, and South African application No. 845542 dated July 18, 1984 filed by Izumichi and Ohyama.

It is known to apply the work developed by the refrigeration expander toward additional warm-end compression of part of the compressed air supply. The incremental compression obtained thereby is very economical, since the drive power is "free" and the capital cost of the compander is little different from the capital cost of an expander with some other means of absorbing the power developed. The further compressed air may then be used for conventional refrigeration (German patent application No. 28 54 508 published 06/19/80 and filed by Rohde), or for TC LOXBOIL (U.S. Pat. No. 4,133,662, USSR Pat. No. 756150, and South African application No. 845542 (supra)).

When liquid air intermediate reflux is applied to the LP distillation column, the initial amount added allows a virtually one-for-one reduction in the air supplied to the HP rectifier (for a specified recovery and purity). The benefit from intermediate reflux continues to increase as more is added until a "pinch" is reached: the operating line closely approaches the equilibrium line. Further additions of intermediate reflux beyond that point decrease the benefit, i.e., provide no more decrease in the amount of air which must be supplied to the HP rectifier in order to yield the overhead reflux required. The same benefit is obtained from intermediate refluxing the HP rectifier. For an air separation process wherein liquid air is used as intermediate reflux, the optimal amount of liquid air reflux is about 5 to 10% of the feed air, for both the LP column and the HP rectifier. Greater liquid air flow rates do not provide any further decrease in the overhead ($LN_2$) reflux requirement.

Several prior art disclosures require that air be supplied to the cold box at two different pressures. One example is the group of companded refrigeration patents described above. Further examples include processes in which the higher pressure air is used to evaporate liquid oxygen (U.S. Pat. Nos. 3,754,406, 4,133,662, and 4,372,764); processes wherein the higher pressure air supplies a second higher pressure rectifier (U.S. Pat. Nos. 4,356,013 and 4,604,116); and also a nitrogen production process wherein the higher pressure fraction reboils the lower pressure column by total condensation (U.S. Pat. No. 4,448,595).

The conventional cryogenic air separation flowsheets provide the bulk of the refrigeration necessary for the overall separation process in either of two conventional manners: by work expanding either part of the HP rectifier overhead nitrogen to exhaust pressure (slightly below LP column overhead pressure), or expanding part of the feed air to LP column intermediate height pressure. U.S. Pat. No. 3,327,488 illustrates the above two approaches in the same flowsheet, although for economic reasons usually only one or the other is used.

The refrigeration compensates for heat leaks, heat exchanger inefficiency, and other effects. Even with the most modern and efficient expanders, there is still required an expander flow of between about 8 and 15% of the inlet air flow to provide the necessary refrigeration, dependent on the size and design of the separation plant. This flow represents a loss of process efficiency, which can be manifested in various ways: lower recovery and/or purity of oxygen than would otherwise be possible; lower recovery and/or purity of coproduct argon; more machinery (and capital cost) to achieve acceptable recoveries and purities; or lower $O_2$ delivery pressure than would otherwise be possible.

Conventional air expansion refrigeration represents a loss of separating power because all the nitrogen contained in the expanded air must be rejected from the overhead of the LP column, yet no $LN_2$ for refluxing the LP overhead is obtained from that portion of the air because the air bypasses the HP rectifier.

Conventional $N_2$ expansion refrigeration represents a loss of separating power because any $N_2$ used for expansion necessarily cannot be used as $LN_2$ reflux. This is partially offset by the reduction in $N_2$ which must be rejected from the LP column overhead, i.e., by a reduction in the amount of required LP column $LN_2$ reflux.

At least four modes of refrigeration are possible which have neither of the above disadvantages—that either air bypasses the HP rectifier or nitrogen bypasses the entire LP column. Those modes are characterized by the vapor undergoing only a partial expansion, and also involving a liquid phase of that vapor either before or after expansion. Since the vapor is only partially expanded, i.e., experiences a less-than-usual pressure ratio of expansion, more expander flow is necessary than with conventional refrigeration. Since the expander flow in all cases bypasses the stripping section of the LP column, this category of refrigeration techniques makes it more difficult to achieve high $O_2$ purities, thus offsetting the advantage it provides of making it easier to achieve high $O_2$ recoveries.

The particular embodiments within this refrigeration category or genus are characterized by what vapor is being partially expanded. One embodiment entails expanding the HP rectifier supply air, prior to introduction to the HP rectifier: U.S. Pat. Nos. 2,812,645 and 4,303,428. A second embodiment is to use a minor fraction of the supply air, which is expanded to bypass the HP rectifier, and is condensed in a latent heat exchanger providing intermediate reboil to the LP column. This is described in U.S. Pat. No. 4,543,115, British Pat. No. 1271419, and further disclosed in copending application Ser. No. 946,484 filed by Donald C. Erickson on Dec. 24, 1986. A third embodiment is to use HP rectifier overhead $N_2$, which after partial expansion is condensed in a latent heat exchanger providing intermediate reboil to the LP column. This is disclosed in copending application Ser. No. 885,868 filed by Donald C. Erickson on July 15, 1986. The fourth embodiment is to at least partially evaporate kettle liquid by latent heat exchange with HP rectifier vapor, thereby refluxing the HP rectifier, and then expanding the evaporated kettle liquid to LP column pressure for feeding thereto. This embodiment is believed to be newly disclosed herein. For ease in distinguishing among the above four refrigeration techniques, they are assigned names as follows: PERA (partial expansion of rectifier air); AIRPER (air partial expansion refrigeration); NIPER (nitrogen partial expansion refrigeration); and KELPER (Kettle liquid partial expansion refrigeration).

One final prior art reference pertinent to the disclosed invention is the September 1975 technical article "Production of Large Quantities of Oxygen by an Improved Two-Column Process" by M. Streich and J. Dworschak, pp. 513–519 of the XIV International Congress of Refrigeration.

Fractional distillation, or simply distillation, has the conventional meaning of separation of a fluid mixture into at least two components of differing volatility via at least one zone of counter-current vapor-liquid contact. "Intermediate height" signifies a height having a zone of counter-current vapor-liquid contact both above and below that height. "Intermediate reflux height" signifies an intermediate height in the rectifying section of a distillation column, i.e., between the feed height and the overhead reflux height. "Intermediate reboil height" signifies an intermediate height in the stripping section, i.e., between the feed height and the bottom reboil height. The means for counter-current contact can be any known type; sieve trays, bubble cap trays, random packing, structured packing, woven mesh, and the like. "Latent heat exchange" signifies that both the heat source fluid and heat sink fluid undergo at least a partial phase change, but does not preclude there being accompanying sensible heat exchange.

One major improvement objective in the production of medium-to-high purity oxygen is to reduce the energy consumption, i.e., the required air supply pressure. However, an energy reduction is only beneficial when not accompanied by an offsetting reduction in either product purity or product yield.

For the various medium purity (85 to 98% purity) $O_2$ processes disclosed above, the lowest air supply pressure possible is set by the requirement that partially condensing supply air must reboil the LP column. For example, with an LP column operating at a bottom pressure of 1.36 ATA (20 psia), and a corresponding temperature of 93.2K (−292° F.), the partially condensing air should be no colder than about 94.7K, setting the air pressure requirement at the reboiler at about 3.9 ATA (57.7 psia). If the reboil air totally condenses, an even higher pressure is necessary to keep it above 94.7K: 4.3 ATA (63.5 psia). With the lower pressure, partial condensation route, if PC LOXBOIL is also incorporated in order to maintain desirable high $O_2$ production pressure, then the $O_2$ recovery or yield becomes unacceptably low. This occurs because less than half of the supply air is routed to the HP rectifier, and not enough $LN_2$ can thereby be obtained for fully refluxing both the LP column and the HP rectifier.

It is possible to achieve full recovery (e.g., greater than 95% recovery) of medium purity oxygen in a flowsheet incorporating both partial condensation reboil and also PC LOXBOIL, provided one of the "partial" refrigeration techniques described above is incorporated. Even then, however, the basic limitation described above of requiring an air pressure of at least about 3.9 ATA at the LP column reboiler is effective. Adding approximately 0.4 ATA for heat exchange, cleaning and drying, sets the air compressor discharge pressure at 4.3 ATA.

What is needed in medium purity oxygen production, and one objective of the present invention, is a means of further reducing the required air supply pressure below that necessary with partial condensation reboil plus PC LOXBOIL, while retaining full $O_2$ recovery and low cost and reliable capital equipment.

For high purity oxygen, above 98% purity and more typically above 99.5% purity, the same goals of reduced energy consumption without offsetting decrease in $O_2$ recovery apply. Usually an important additional factor must also be included: the recovery of crude argon. When recovered, the argon typically adds 4 to 10% to the value of product. Thus, for example, a process for high purity oxygen which reduces energy by 10% while retaining full $O_2$ recovery, but which also fails to recover argon, is actually disadvantageous.

Three high purity flowsheets have been disclosed in which the $N_2$ rejection column is reboiled by partially condensing air vice HP rectifier $N_2$, thus reducing the required air supply pressure from 5.9 ATA to 4.6 ATA. They are shown respectively in U.S. Pat. No. 3,688,513; 4,507,134; and 4,578,095. The first fails to recover argon but achieves nearly full $O_2$ recovery. The second has substanitally reduced argon recovery and also significantly reduced oxygen recovery, due to high expander flow requirement and TC LOXBOIL (both of which reduce the air supply to the HP rectifier and hence, reduce the $LN_2$ available for reflux). Also, a slightly higher air supply pressure is required—4.75 ATA. The third disclosed technique achieves conventional levels of crude argon recovery (about 60%) and also very nearly full oxygen recovery, where full $O_2$ recovery is possible depending on the refrigeration mode selected.

The first and third process evaporate LOX with HP rectifier $N_2$, whereas the second process achieves a somewhat higher $O_2$ delivery pressure via TC LOXBOIL with $O_2$-depleted air. All three of the disclosures share the shortcoming that no extra separatory power is available for the purposes of either coproducing any significant amount of pressurized nitrogen, or making more refrigeration to allow some product withdrawal as liquid. (Both of those could be done, but only at the expense of a more-than-offsetting decrease in $O_2$ recovery).

What is needed in high purity oxygen production, and a second objective of the present invention, is a low energy triple pressure flowsheet which requires air supply pressures no higher than those of the partial condenstion reboil triple pressure flowsheets (and preferably even lower), and allows full $O_2$ recovery plus full conventional argon recovery (or higher), and which also has the capability of coproduct pressurized $N_2$ and/or some liquid production.

Surprisingly the same generic technique or combination of features has been found to accomplish both of the above objectives.

DISCLOSURE OF INVENTION

Disclosed hereby is a new combination of for-the-most-part known steps or components whereby the disadvantages present in prior art teachings for producing medium-to-high purity oxygen at high recovery are overcome and the energy requirement is substantially reduced, while retaining full $O_2$ recovery plus other desirable advantages.

The disclosed improvement to cryogenic air separation processes and/or apparatus incorporating two or more distillation columns operating at different pressures is comprised of:

(a) Additionally compressing a minor fraction of the supply air to a pressure higher than the pressure of the major fraction of compressed supply air;

(b) reboiling the lower pressure column by total condensation of the minor air fraction;

(c) transporting part of the resulting liquid air to an intermediate reflux height of the higher pressure column and another part to an intermediate reflux height of the lower pressure column; and (d) withdrawing gaseous oxygen product after evaporating lower pressure column bottom liquid oxygen by exchanging latent heat with at least one of supply air and higher pressure column overhead vapor, said exchange of latent heat occurring in a LOX evaporator which is separate from the LP column bottom reboiler.

In the preferred embodiment, the additional compression is accomplished by a compander including a cold-end expander which provides at least part of the required process refrigeration, thereby effectively avoiding most of the capital and energy expense of the additional compression.

One important reason for the high distillation efficiency and resulting low energy requirement of this disclosure is that a nearoptimal amount of liquid air is produced for use as intermediate reflux, the total amount being in the range to 10 to 25% of the supply air. Since the total condensation reboil is additionaly compressed, reboil temperature at or above corresponding to partial condensation of the majority of the air are readily achieved. On the other hand, since only a minor fraction of the air is additionally compressed, and through only a low compression ratio (to between about 1.1 and 1.3 times the pressure of the main supply of compressed air), the additional compression energy is very small, and corresponds to the amount of work expansion energy typically available.

Surprisingly, this same technique solves the classical problems of the low-energy flowsheets for both medium purity (no argon recovery) and high purity (usually with argon recovery) oxygen processes. The primary differences between the two applications are that for medium purity, normally a dual pressure column is employed and product oxygen is evaporated via PC LOXBOIL, whereas for high purity the triple pressure column configuration is employed and usually at least most, if not all, of the product oxygen is evaporated by heat exchange with HP rectifier overhead vapor. Within each category other possible differences and variants will be apparent to the artisan, some of which are illustrated by the drawings.

BRIEF DESCRIPTION OF THE DRAWINGS

FIG. 1 illustrates conventional HP rectifier $N_2$ expansion refrigeration, conventional HP rectifier reflux, plus partial condensation intermediate reboil.

FIG. 2 illustrates NIPER refrigeration, HP rectifier reflux by kettle liquid distillation, and no separate intermediate reboil of the LP column (besides those inherent in the multiple feed locations for the fluid from the kettle liquid).

FIG. 3 illustrates KELPER refrigeration, intermediate reboil by two stage sequential total condensation of the companded air, and HP rectifier reflux by the second sequential stage of kettle liquid evaporation.

FIG. 4 illustrates PERA refrigeration, intermediate reboil via TCFR with part of the major fraction of supply air (vice the additionally compressed fraction), and once again HP rectifier reflux via kettle liquid distillation.

BEST MODE FOR CARRYING OUT THE INVENTION

Figure 1:
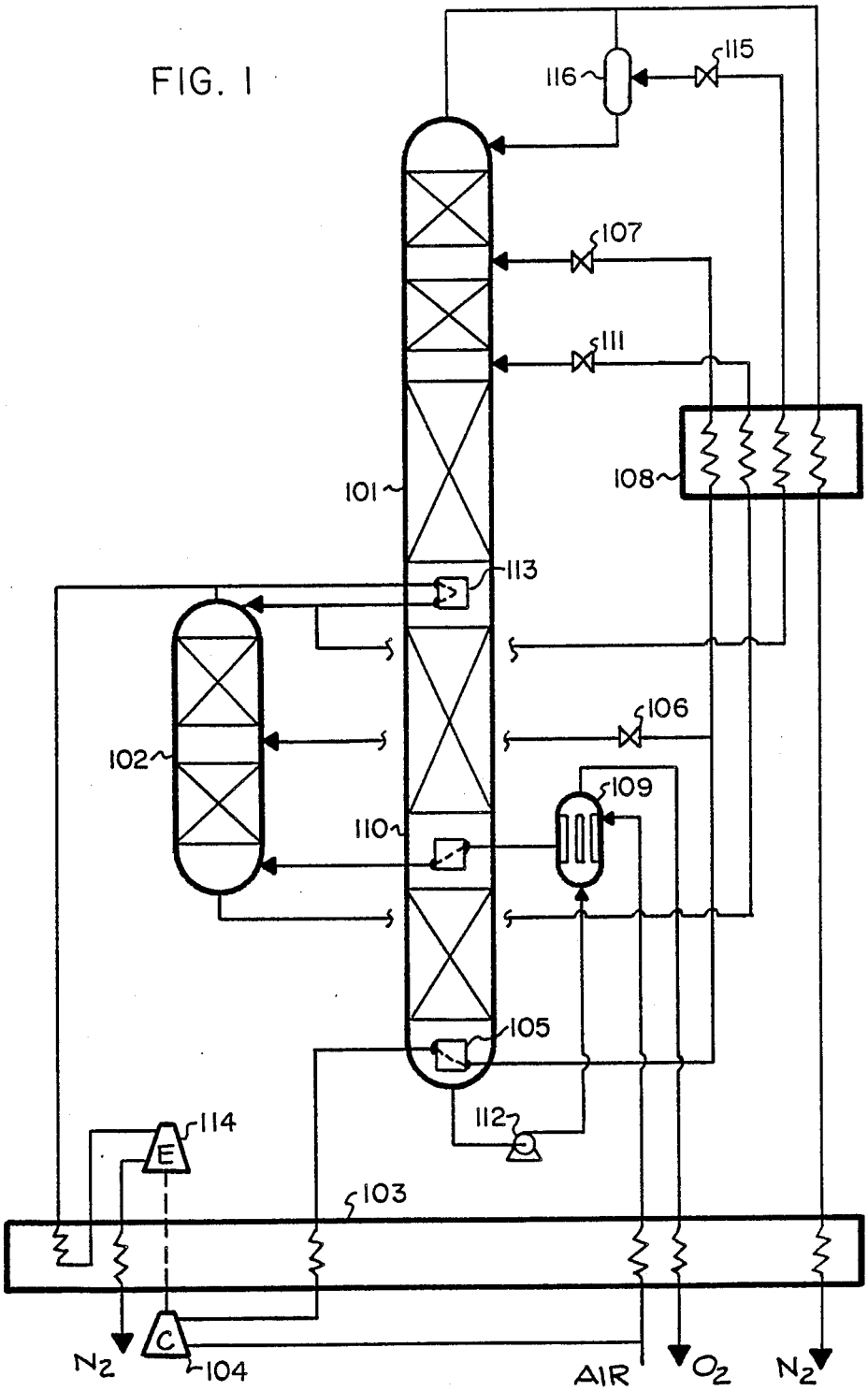
FIGS. 1 through 4 illustrate the application of the disclosed technique, "companded total condensation reboil plus liquid air split" (companded TCFR/LAIR-SPLIT), to medium purity $O_2$ flowsheets. Three types of variation within that category are illustrated in the several figures: how refrigeration is developed, how the HP rectifier is refluxed, and how intermediate reboil is applied to the LP column.

Referring to FIG. 1, a dual pressure column configuration is comprised of LP column ($N_2$ rejection column) 101 and HP rectifier 102. Supply air which has already been cleaned, compressed, and dried is split into two fractions. The major fraction is cooled in main heat exchanger 103, while the minor fraction comprised of 10 to 25% of the supply air is additionally compressed by 104 before cooling. The cooled minor fraction is substantially totally condensed in LP column reboiler 105, and the liquid air is split into two intermediate reflux streams by valves 106 and 107, the former stream being fed to column 102 and the latter to column 101 (after optional subcooling in heat exchanger 108). The major fraction of cooled supply air is first used to evaporate product oxygen by partial condensation in LOX evaporator 109, next undergoes additional partial condensation to provide intermediate reboil to column 101 via latent heat exchanger (intermediate reboiler) 110, and finally is fed to the bottom of column 102. The liquid bottom product from rectifier 102, an oxygen enriched liquid air of about 35% $O_2$ content, is fed to the LP column 101 via valve 111. The medium purity (85 to 98% $O_2$ content) liquid oxygen bottom product from column 101 is routed to LOX evaporator 109 via means for liquid transport 112, which may be a pump or simply a valve, depending on the relative pressures and heights of evaporator 109 and column 101 sump. The two pressures will normally be approximately equal, and operation without a pump is preferred. HP rectifier 102 is refluxed by exchanging latent heat between overhead vapor and LP column 101 intermediate height liquid at latent heat exchanger 113. Part of the overhead vapor is partially warmed in 103 and workexpanded in 114 to exhaust pressure, thereby providing both process refrigeration and the drive power for warm-end compressor 104. Part of the $LN_2$ obtained in 113 is routed via pressure letdown valve 115 and optional phase separator 116 to the overhead of column 101 as reflux therefor. Product gaseous oxygen is withdrawn from 109, and exhaust nitrogen is withdrawn from the overhead of 101.

Figure 2:
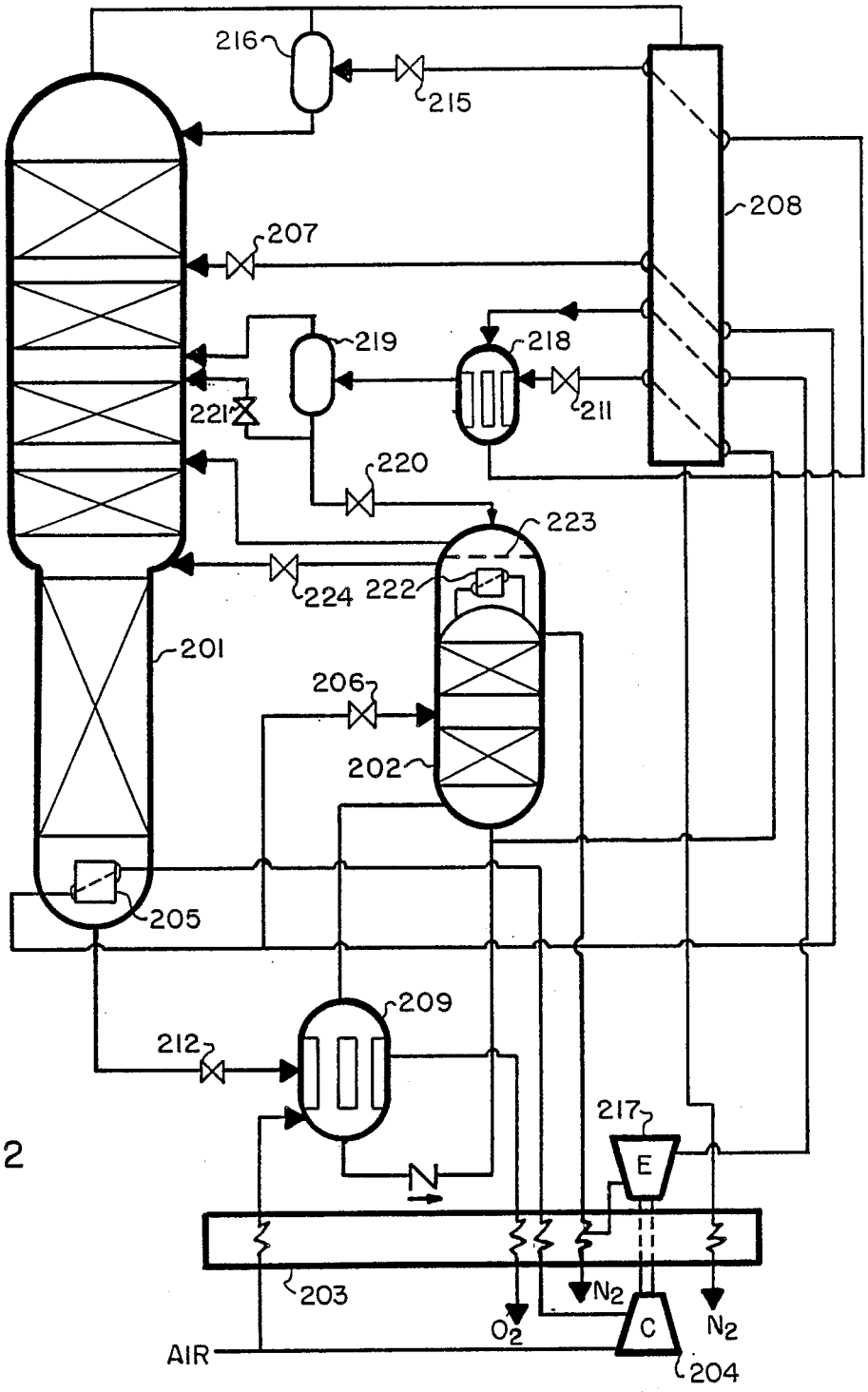

The process depicted in the simplified flowsheet of Figure 2 performs a similar function—medium purity $O_2$ production—and the components 201 through 209, 211, 212, 215, and 216 have descriptions similar to the corresponding 100 series components of FIG. 1. The salient differences from FIG. 1 are the means of producing refrigeration and the means of refluxing rectifier 202, both of which involve use of kettle liquid. Refrigeration is via NIPER: overhead vapor from rectifier 202 is partially warmed (as before), but then is only partially expanded in 217 to an intermediate pressure, set high enough that it will condense in latent heat exchange with either of two liquids—LP column 201 intermediate reflux height liquid, or preferably against kettle liquid which has been depressurized to column 201 pressure by valve 211. The latter case, which is the one illustrated, accomplishes partial evaporation of the kettle liquid in $N_2$ condenser 218. Phase separator 219 plus valves 220 and 221 allow routing of part of the unevaporated liquid to HP rectifier 202 reflux apparatus, while any remaining liquid and all of the vapor are fed to column 201. The reflux apparatus is comprised essentially of latent heat exchanger 222, and preferably also of a zone of countercurrent vapor-liquid contact 223, e.g., a sieve tray. Vapor withdrawal connections are provided both above and below the contact zone, for feeding to different heights of the LP column 201. One or more valves 224 may be supplied to control the relative amounts of fluid withdrawn through each connection. The advantage of contactor 223 is that because of it the vapor stream through valve 224 can have a lower $N_2$ content than that of the liquid supplied through valve 220. Thus vapor is fed to a lower height of column 201 than would otherwise be possible, and hence the reboil requirement at reboiler 206 is reduced. For this flowsheet a typical amount of air supplied to 205 is 17% of the supply air; this provides the near-optional amount of intermediate liquid air reflux to both columns via valves 206 and 207. It is preferred that the entire $LN_2$ requirement at valve 215, typically about 31.5% of the supply air, be condensed at 218; this avoids the need to also withdraw $LN_2$ from column 202, or alternatively to pump some of the $LN_2$ from 218 back to column 202. Clearly, however, this is not mandatory. Gases lighter than $N_2$, such as He and Ne, will tend to concentrate in the vapor space of 218, and a trace vapor stream may be withdrawn to recover them. Also, gases heavier than oxygen such as Kr and Xe will concentrate in the liquid of component 209 (PC LOXBOILER), and can be recovered from a trace stream of withdrawn liquid. This applies to all the flowsheets.

The process depicted in the simplified flowsheet of FIG. 3 also produces medium purity oxygen, and components numbered 301–312, 315 and 316 are described similarly as in FIG. 1, with differences as noted below. The minor fraction of air which is additionally compressed and then substantially totally condensed so as to provide reboil to column 301 does so in two stages—partly in reboiler 305, providing bottom reboil, and the remainder in intermediate reboiler 310. Optional phase separator 326 allows only the uncondensed vapor to be routed to 310, and valves 306, 307, and 327 divide the liquefied air into intermediate reflux streams for both columns. The advantage of this two-step total condensation reboil sequence are that the air in 305 can be at a slightly lower pressure to achieve a given temperature since it isn't yet totally condensed there.

Figure 3:
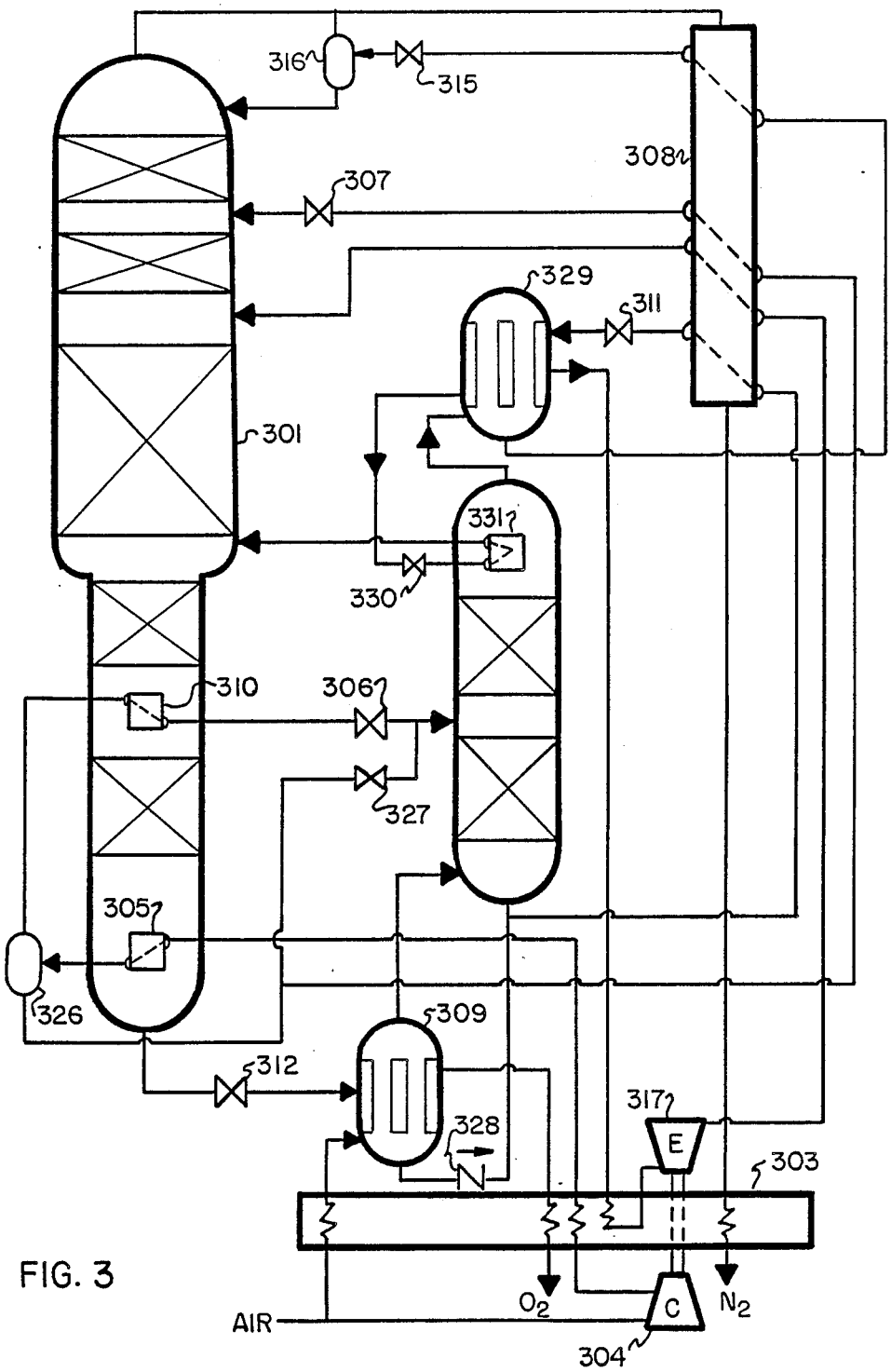

The refrigeration technique depicted in FIG. 3 is "KELPER": kettly liquid from 302 (including partial condensation liquid from 309 via one-way valve 328) is partially depressurized by valve 311 and fed to evaporator 329, where it is partially condensed while exchanging latent heat with HP rectifier 302 overhead vapor. The unevaporated liquid is then fully depressurized to column 301 pressure by valve 330, and further evaporated at reflux condenser 331 prior to feeding to column 301. The intermediate pressure vapor from 329 is partially warmed in 303 and then work-expanded to column 301 pressure while producing both refrigeration and drive power for compressor 304.

Figure 4:
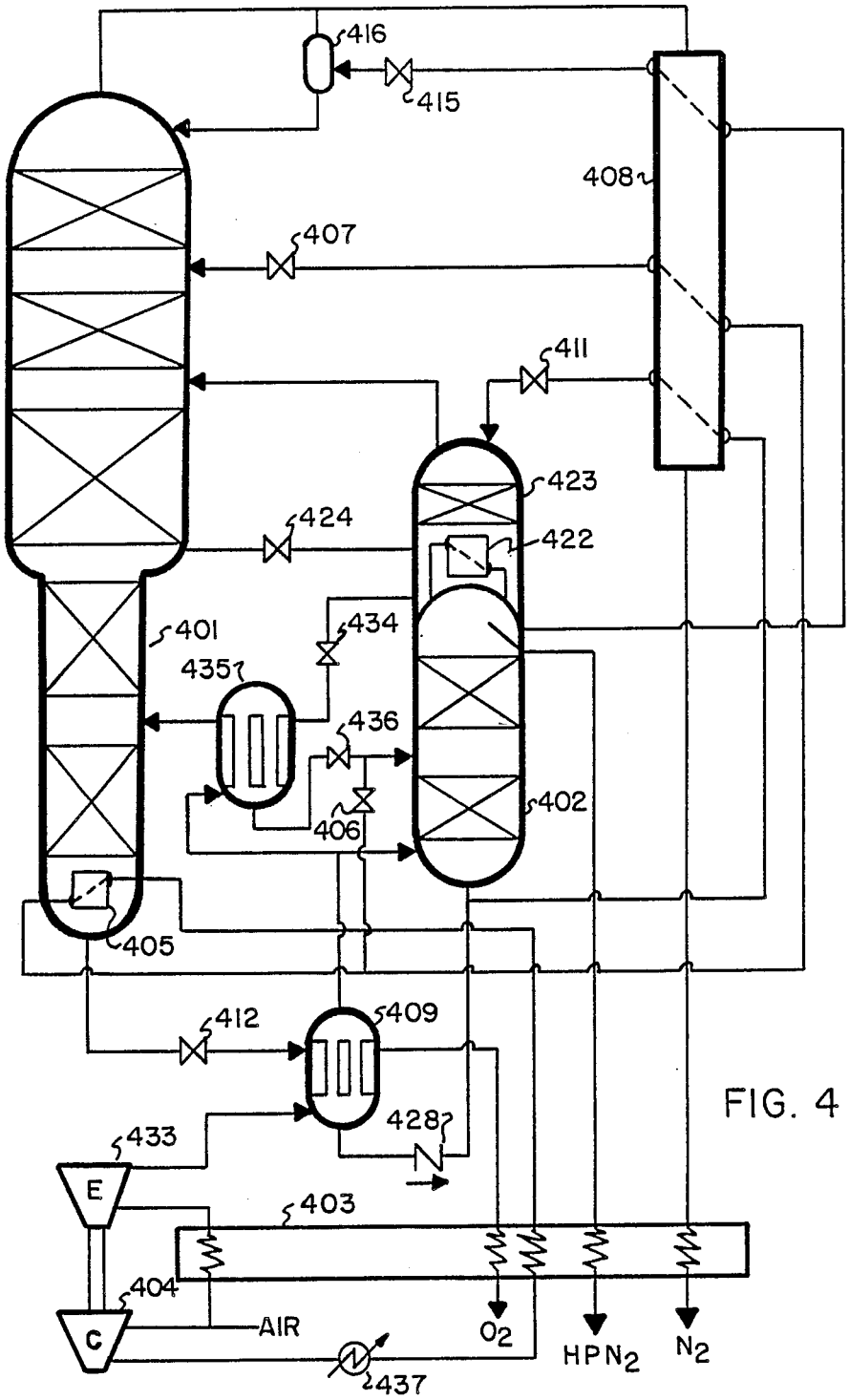

The process depicted in the simplified flowsheet of FIG. 4 illustrates yet another combination of refrigeration technique, HP rectifier reflux technique, and LP column intermediate reboil technique which can be incorporated in a medium purity $O_2$ process incorporating the basic inventive entity of companded TCFR plus liquid airsplit. Components numbered 401–409, 411, 412, 415, and 416 are described similarly as the corresponding 100 series components of FIG. 1. Refrigeration in FIG. 4 is by PERA: the major fraction of supply air is partially expanded in expander 433 before routing to 409 for PC LOXBOIL. Compressor 404 which boosts the pressure of the TCFR air may be externally powered by motor 438 as illustrated, rather than by expander 433 as illustrated in the other figures. Since approximately 80% of all the supply air is expanded, only a very small pressure ratio of expansion is required, e.g., from 54 psia to 46 psia. HP rectifier 402 is refluxed by latent heat exchanger 422, counter-current vapor-liquid contact zone 423, depressurized kettle liquid feed through 411, and two vapor withdrawal connections (above and below zone 423) for feeding vapor of differing composition to different heights of 401, using valve 424 to control the respective amounts of vapor flow. LP column 401 receives vapor feed at an intermediate reboil height from latent heat exchanger 435, which is supplied unevaporated oxygen-enriched kettle liquid via valve 434, and a small fraction of the uncondensed air from 409. The substantially totally condensed air through valve 436 joins that from valve 406 to form intermediate reflux for the HP rectifier 402. Optional cooler 437 downstream of additional compressor 404 removes compression heat with ambient or other cooling, and may be incorporated in any of the flowsheets.

FIGS. 1 through 4 all share the disclosed invention as a means of both reboiling the LP column and intermediate refluxing both columns. Each has a different refrigeration technique, a different technique for providing intermediate reboil to the LP column, and a different technique for providing boiling liquid to the HP rectifier reflux condenser. It is emphasized that the particular groupings illustrated by the figures are in no way limiting; any other conceivable combination of 1 of 4 choices for refrigeration, 1 of 4 choices for intermediate reboil, and 1 of 4 choices for reflux, is also possible, making a total of 64 possible choices. Beyond that, still other choices are possible, e.g., conventional refrigeration, or incorporating more than one choice from any category in the same flowsheet. The intended scope of the disclosed generic invention is that it is applicable to any cryogenic air separation process involving at least two columns at different pressures.

Generically the disclosed invention requires that there be supplied two streams of supply air—a major stream at one pressure in the approximate range of 3.5 to 6 ATA, and a second minor stream at about 1.1 to 1.3 times the pressure of the major stream. It is not necessary that a compander be used for this task (although it is preferred). Alternatively, an externally powered compressor could be used, either to further compress part of the main air compressor discharge, or to fully compress a completely separate air stream. The former option is preferred, as thereby the air cleaning and drying can be accomplished in a single apparatus. Another generic feature is that the product gaseous oxygen be evaporated either by HP rectifier overhead vapor or by partial condensation of the major stream of supply air. This ensures a reasonably high $O_2$ delivery pressure, and hence excludes those processes which may obtain more $LN_2$ for reflux and high recovery by depressurizing the LOX to unacceptably low values.

Figure 5:
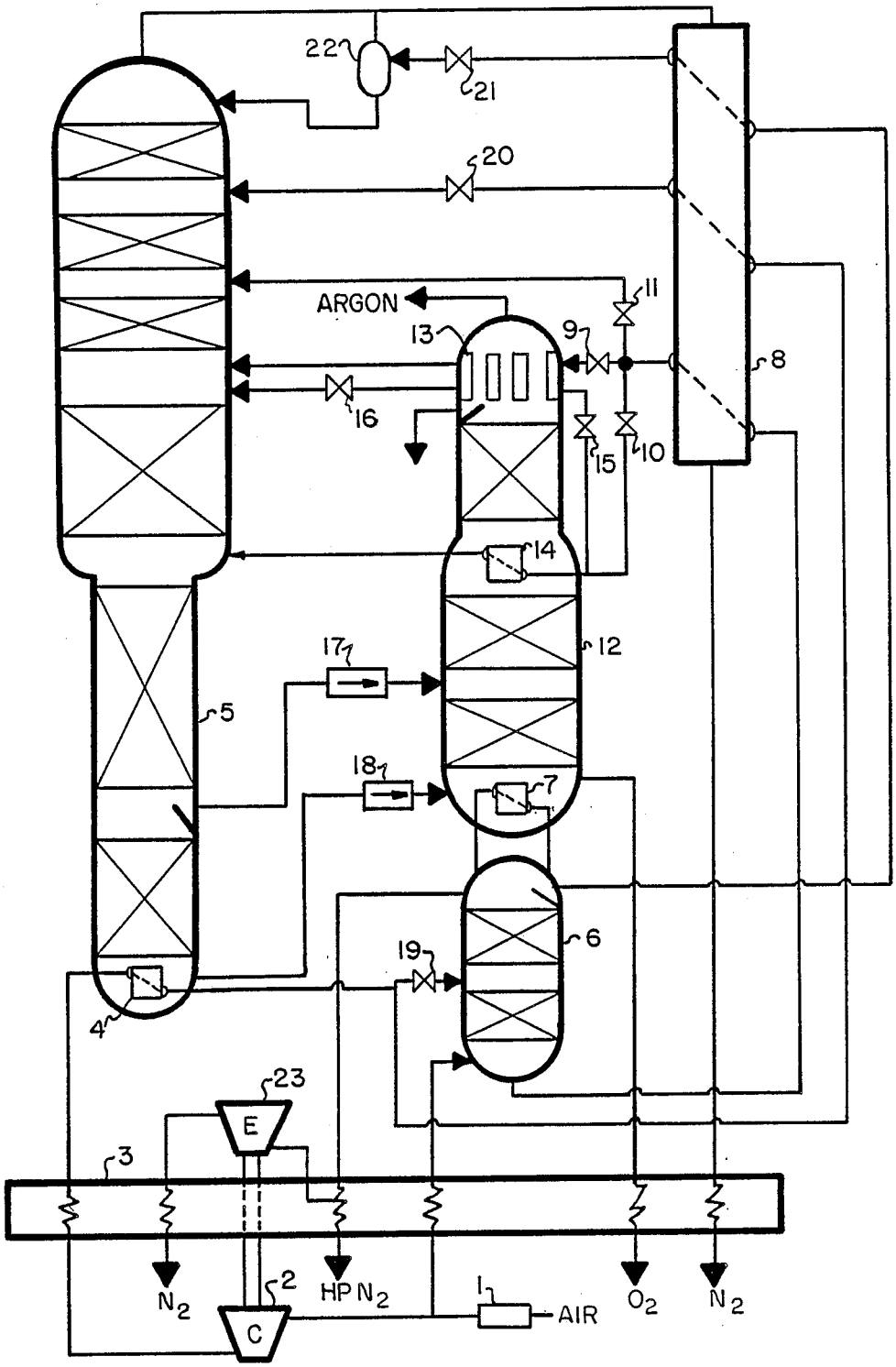

The generic features described above are found surprisingly to not only solve long-standing problems in the production of medium purity oxygen, as indicated in FIGS. 1 through 4, but to also solve longstanding problems in the production of high purity oxygen plus coproduct crude argon, as illustrated by the simplified schematic flowsheet of FIG. 5. In that figure, supply air is cleaned, compressed, and cooled in section 1 and then divided into a major and minor stream. The minor stream, about 20 to 28% of the air (typically 24%) is additionally compressed at 2, cooled in main exchanger 3, and supplied to reboiler 4 of the $N_2$ rejection column 5. The major stream of air is cooled in 3 and supplied to HP rectifier 6, having overhead reflux condenser 7. Kettle liquid bottom product from 5 is cooled in 8, split into at least two streams and depressurized by valves 9, 10, and 11, and then used to reflux argon-oxygen column 12. Valve 9 supplied kettle liquid to overhead reflux condenser 13, and valve 10 supplies intermediate height reflux condenser 14. It is frequently desirable that the evaporated kettle liquid from 14 have a slightly higher $O_2$ content than the kettle liquid, e.g., 41% vice the 39% in one example kettle liquid. The higher $O_2$ content allows a reduction in air supplied to 4. To accomplish that, valve 15 bleeds in some additional oxygen enriched kettle liquid to 14, providing the desired composition. Valve 16 controls the fraction of the kettle liquid traversing 9 which is evaporated, thus controlling condenser 13 temperature. This temperature is very critical from the viewpoint of preventing argon freezeup, and should never be allowed to go below about 88K. Valve 11 bypasses kettle liquid directly to column 5 when necessary to prevent excessively low temperatures at 13. Column 12 is fed a liquid sidestream of oxygen and argon (about 5% argon) from column 5 via means for transport 17—a pump or a one-way valve for example. Approximately two-thirds of the oxygen is obtained as liquid bottom product from column 12, and one-third in column 5; this is approximately the same proportion as the reboil supplied by reboiler 7 compared to that by reboiler 4. Also, in the preferred embodiment reboiler 7 also evaporates the liquid oxygen from both columns to gaseous product which is withdrawn. Column 5 LOX is transported to column 12 sump for evaporation by means for transport 18. Column 12 pressure is typically 15 psia, and column 5 pressure is typically 21 psia, hence pressure difference alone will provide the necessary transport force for both 17 and 18 provided the column height differences are not too great. Liquid air from 4 is split into two streams by valves 19 and 20 and used to intermediate reflux both columns by direct injection. Liquid $N_2$ from 7 refluxes both rectifier 6 and also column 5 via pressure letdown valve 21 and phase separator 22. Process refrigeration can be via any known technique; one preferred example as illustrated is the partial warming and full expansion in 23 of some $N_2$ from rectifier 6 (typically about 13% of the supply air). Expander 23 powers warm-end compressor 2, thereby minimizing energy demand and capital cost. Crude argon may be withdrawn from column 12 overhead either as liquid or as vapor. It is at a pressure typically slightly below atmospheric, e.g., 13 psia, and hence a barometric leg of crude liquid oxygen is a convenient way to pressurize it prior to evaporation. It is essential for full $O_2$ recovery and conventional levels of argon recovery that the vapor streams from 13 and 14 be fed to different heights of column 5, or alternatively that either or both refluxers exchange heat directly with LP column liquid at the respective feed heights.

I claim:

1. A process for producing oxygen from a supply of compressed air by cryogenic fractional distillation comprising:

(a) cooling and rectifying a major fraction of said supply air in a HP rectifier to nitrogen overhead product and kettle liquid bottom product;

(b) distilling the kettle liquid in a low pressure nitrogen rejection column (LP column) to overhead waste nitrogen and oxygen bottom product;

(c) additionally compressing a minor fraction of said supply air;

(d) cooling said additionally compressed air and condensing it to liquid by exchanging latent heat with at least LP column bottom liquid in at least one reboiler, thereby providing bottom reboil to said LP column;

(e) providing part of the liquefied additionally compressed air from step d) to an intermediate height of the HP rectifier as intermediate reflux therefor, and providing the remaining part to an intermediate height of the LP column as intermediate reflux therefor; and (f) evaporating said oxygen bottom product at a pressure no less than the LP column pressure and withdrawing the gaseous oxygen as product.

2. Process according to claim 1 further comprising:

(a) providing refrigeration by work-expanding a process vapor stream; and (b) powering said additional compression step by the work developed in said work-expansion step.

3. Process according to claim 1 further comprising:

(a) withdrawing a liquid sidestream consisting essentially of oxygen and argon from an intermediate height below the feed height of said LP column;

(b) distilling said stream in an argon column to oxygen bottom product and crude argon overhead product; and (c) withdrawing said argon as coproduct.

4. Process according to claim 1 further comprising:

(a) increasing the pressure of the liquid oxygen bottom product from the LP column prior to said evaporation to product gaseous oxygen; and (b) evaporating said pressurized liquid oxygen by exchanging latent heat with the supply air to the HP rectifier which is partially condensed thereby.

5. Process according to claim 4 further comprising using an externally powered compressor to provide at least part of said additional compression.

6. Process according to claim 4 further comprising (a) providing refrigeration by work-expanding a process vapor stream; and (b) providing at least part of the power used for said additional compression from the work developed in said work-expansion step.

7. Process according to claim 6 further comprising:

(a) producing oxygen at a purity of between about 85 and 98%, and at a recovery of at least about 95%;

(b) providing supply air in the approximate range of 3.4 to 4.4 times atmospheric pressure;

(c) companding said minor air fraction, comprising between about 10 and 25% of said supply air, to a pressure higher than the supply pressure by a factor of about 1.1 to 1.3, and (d) dividing said liquid into said parts for intermediate refluxing in roughly equal proportions which differ by not more than a factor of three.

8. Process according to claim 7 further comprising: exchanging latent heat from HP rectifier overhead vapor to LP column intermediate height liquid, thereby providing intermediate reboil to the LP column and liquid $N_2$ for refluxing the overhead of both the HP rectifier and the LP column.

9. Process according to claim 7 further comprising:

(a) partially warming and work-expanding HP rectifier overhead vapor to an intermediate pressure;

(b) condensing said intermediate pressure vapor by exchanging latent heat with at least one of:

(i) depressurized kettle liquid, and (ii) LP column intermediate height liquid; and (c) refluxing the LP column overhead with the $LN_2$ condensate obtained thereby.

10. Process according to claim 7 further comprising: providing process refrigeration by work expanding said major fraction of supply air so as to cool it by at least about 2K prior to rectifying it in said HP rectifier.

11. Process according to claim 7 further comprising condensing said additionally compressed air in two sequential steps, first by exchanging latent heat with LP column bottoms liquid, and secondly exchanging latent heat between the remaining uncondensed portion and LP column intermediate height liquid.

12. Process according to claim 7 further comprising conducting at least one exchange of latent heat between at least partially depressurized kettle liquid and HP rectifier overhead vapor, thereby providing liquid $N_2$ for refluxing the overhead of both the HP rectifier and the LP column, and thereby at least partially evaporating said kettle liquid prior to said distilling in the LP column.

13. Process according to claim 12 wherein said kettle liquid is only partially depressurized prior to and partially evaporated during said first exchange of latent heat, and further comprising:

(a) partially warming and work-expanding the vapor fraction of said partial evaporation, thereby providing the power for said companding;

(b) feeding the expanded vapor to said LP column; and (c) further depressurizing and further evaporating the unevaporated portion of said kettle liquid, and feeding it to a lower feed height of said LP column.

14. Process according to claim 12 further comprising:

(a) providing a zone of countercurrent vapor-liquid contact between the HP rectifier overhead vapor latent heat exchanger and the feed point for depressurized kettle liquid; and (b) withdrawing fluid streams of differing compositions from above and below said contact zone and feeding them to different heights of said LP column.

15. Process according to claim 12 further comprising:

(a) exchanging latent heat between a minor stream of oxygen-enriched kettle liquid, remaining after said HP rectifier overhead vapor latent heat exchange, and a totally condensing minor stream of air diverted from said supply to the HP rectifier; and (b) feeding the evaporated oxygen-enriched kettle liquid to a lower intermediate height of the LP column than the feed height of said partially evaporated kettle liquid.

16. Process for separating oxygen and optional coproduct crude argon from air by cryogenic distillation of a supply of compressed and cleaned air comprising:

(a) cooling and distilling a major fraction of said supply air in a high pressure (HP) rectifier to nitrogen overhead product and kettle liquid bottom product;

(b) work-expanding a cold process stream to produce refrigeration;

(c) additionally compressing the remaining minor fraction of air comprising between about 10 and 26% of the total air supply with the work from said expansion;

(d) feeding said kettle liquid in fluid phase to at least one height of a low pressure nitrogen rejection column for distillation to waste nitrogen overhead product and product purity fluid oxygen bottom product;

(e) cooling said additionally compressed air and condensing it to liquid by exchanging latent heat with at least LP column bottom liquid; and (f) dividing the resulting liquid air into two streams and feeding one to an intermeidate reflux height of the LP column and the other to an intermediate reflux height of the HP rectifier.

17. Process according to claim 16 further comprising:

(a) increasing the pressure of the LP column liquid bottom product;

(b) evaporating product oxygen at a pressure approximating the LP column bottom pressure for withdrawal by exchanging latent heat between said liquid oxygen and said major fraction of supply air en route to the HP rectifier, which is partially condensed thereby.

18. Process according to claim 17 further comprising:

(a) conducting said work-expansion step on partially warmed HP rectifier overhead vapor;

(b) expanding said vapor to an intermediate pressure;

(c) condensing said intermediate pressure vapor by exchanging latent heat with at least one of depressurized kettle liquid and LP column intermediate height liquid; and (d) refluxing at least the LP column overhead with the liquid $N_2$ obtained thereby.

19. Process according to claim 18 further comprising:

(a) partially evaporating said depressurized kettle liquid by said latent heat exchange with intermediate pressure vapor;

(b) further evaporating the remaining liquid fraction of the partially evaporated kettle liquid by exchanging latent heat with HP rectifier overhead vapor; and

20. Process according to claim 16 further comprising:

(a) transferring LP column intermediate height liquid consisting essentially of oxygen and argon to an oxygen-argon distillation column;

(b) distilling said liquid to crude argon overhead product which is withdrawn and $O_2$ bottom product of at least about 99.5% purity; and (c) reboiling the argon column by exchanging latent heat with HP rectifier overhead vapor which is in the pressure range of about 3.5 to 5 times atmospheric pressure.

21. Process according to claim 20 further comprising:

(a) additionally compressing said minor fraction of the air supply with an externally powered compressor;

(b) cooling and work-expanding said air stream, after both additional compressions but before said condensation, to a pressure higher than said HP rectifier pressure;

(c) increasing the pressure of the liquid oxygen bottom product from both the argon and LP columns to approximately the LP column bottom pressure; and (d) evaporating said pressurized liquid oxygen by exchanging latent heat with the air supply to the HP rectifier, which is partially condensed thereby.

22. Process according to claim 20 further comprising:

(a) refluxing an intermediate height of the argon column by transferring latent heat from intermediate height vapor to at least one of:

(i) depressurized kettle liquid, and (ii) LP column intermediate height liquid; and (b) evaporating the liquid oxygen bottom product from both the argon and LP columns by exchanging latent heat with HP rectifier overhead vapor; and (c) withdrawing the evaporated oxygen as product.

23. Process according to claim 22 further comprising:

(a) supplying one stream of depressurized kettle liquid to an overhead reflux condenser for the argon column and partially evaporating said kettle liquid;

(b) supplying a second stream of depressurized kettle liquid to said intermediated reflux condenser and totally evaporating that kettle liquid stream; and (c) feeding the two fluid streams from steps (a) and (b) having different vapor compositions to different heights of the LP column.

24. Apparatus for cryogenic distillation of a supply of compressed air to oxygen product and optional crude argon coproduct comprised of a HP rectifier, a LP column for distilling the bottom product from the HP rectifier, and a means for evaporating LP column bottom liquid to gaseous oxygen product by exchanging latent heat with at least one of HP rectifier overhead vapor and partially condensing supply air, wherein the improvement comprises:

(a) a compander, comprised of a cold-end expander which work-expands a process vapor stream, and a warm-end compressor which additionally compresses a minor fraction of said compressed air supply;

(b) a bottoms reboiler for the LP column in which said additionally compressed air is liquefied; and (c) a means for dividing said liquid air into two streams and transporting one stream to an intermediate reflux height of the LP column and the other to an intermediate reflux height of the HP rectifier.

25. Apparatus according to claim 24 further comprised of at least one overhead reflux condenser for the HP rectifier in which at least one liquid is at least partially evaporated, said liquid being selected from:

(i) at least partially depressurized kettle liquid;

(ii) LP column intermediate reboil height liquid; and (iii) bottom liquid from an oxygen-argon distillation column in which is distilled a liquid oxygen-argon sidestream withdrawn from an intermediate height of the LP column.

26. Apparatus for cryogenic distillation of a supply of compressed air to oxygen product and optional crude argon coproduct comprised of a HP rectifier, a LP column for distilling the bottom product from the HP rectifier, and a means for evaporating LP column bottom liquid to gaseous oxygen product by exchanging latent heat with at least one of HP rectifier overhead vapor and partially condensing supply air, wherein the improvement comprises:

(a) an externally powered compressor which additionally compresses a minor fraction of said compressed air supply;

(b) a bottoms reboiler for the LP column in which said additionally compressed air is liquefied; and (c) a means for dividing said liquid air into two streams and transporting one stream to an intermediate reflux height of the LP column and the other to an intermediate reflux height of the HP rectifier.

* * * * *